US010919333B2

(12) United States Patent
Raccanello

(10) Patent No.: US 10,919,333 B2
(45) Date of Patent: Feb. 16, 2021

(54) CREASING DEVICE FOR FORMING CREASES IN PAPER AND BOOKBINDING ARTICLES, AND MACHINE COMPRISING SUCH DEVICE

(71) Applicant: K.G.S. S.R.L. UNIPERSONALE, Mestrino (IT)

(72) Inventor: Roberto Raccanello, Padua (IT)

(73) Assignee: K.G.S. S.R.L. UNIPERSONALE, Mestrino (IT)

( * ) Notice: Subject to any disclaimer, the term of this patent is extended or adjusted under 35 U.S.C. 154(b) by 70 days.

(21) Appl. No.: 16/079,007

(22) PCT Filed: Feb. 23, 2017

(86) PCT No.: PCT/IB2017/051033
§ 371 (c)(1),
(2) Date: Aug. 22, 2018

(87) PCT Pub. No.: WO2017/145082
PCT Pub. Date: Aug. 31, 2017

(65) Prior Publication Data

US 2019/0047313 A1 Feb. 14, 2019

(30) Foreign Application Priority Data

Feb. 26, 2016 (IT) ..... 102016000020368

(51) Int. Cl.
*B31F 1/08* (2006.01)
*B42C 7/00* (2006.01)
(Continued)

(52) U.S. Cl.
CPC ..... *B42C 7/005* (2013.01); *B31F 1/0003* (2013.01); *B31F 1/07* (2013.01); *B31F 1/08* (2013.01);
(Continued)

(58) Field of Classification Search
CPC ..... B42C 7/005; B42C 5/04; B42C 13/00; B42C 13/003; B31F 1/08; B31F 1/0003;
(Continued)

(56) References Cited

U.S. PATENT DOCUMENTS 3,847,036 A * 11/1974 Miller ..... B23P 15/406 76/107.8
5,709,376 A * 1/1998 Ushirogata ..... B42C 1/12 270/58.11
(Continued)

FOREIGN PATENT DOCUMENTS

DE 20021343 U1 * 3/2001 ..... B31F 1/0025
DE 101 11 988 A1 2/2002
(Continued)

*Primary Examiner* — Nathaniel C Chukwurah
*Assistant Examiner* — Mobeen Ahmed
(74) *Attorney, Agent, or Firm* — R. Neil Sudol; Henry D. Coleman

(57) ABSTRACT

A creasing device includes a frame with a substantially horizontal support surface for supporting an article to be creased; a movable tool; and a stationary tool, the latter comprising a stationary member and at least one displaceable member whose height relative to the stationary member can be adjusted. A first actuator moves the movable tool toward the stationary tool and interacts with opposite faces of the article, and a second actuator translates the displaceable member between a first end position in which interacts with the movable tool and a second end position in which it cannot interact with the movable tool. Guide means associated with the stationary tool guides the displaceable member between the first end position and the second end position. The guide means are have a curvilinear path contained in a plane substantially perpendicular to the support surface.

9 Claims, 4 Drawing Sheets

(51) Int. Cl.

| | |
|---|---|
| ***B42C 5/04*** | (2006.01) |
| ***B31F 1/07*** | (2006.01) |
| ***B31F 5/00*** | (2006.01) |
| ***B42C 13/00*** | (2006.01) |
| ***B31F 1/00*** | (2006.01) |
| *B31F 1/10* | (2006.01) |
| *B31F 5/02* | (2006.01) |

(52) U.S. Cl.
CPC ..... *B31F 5/005* (2013.01); *B42C 5/04* (2013.01); *B42C 13/00* (2013.01); *B42C 13/003* (2013.01); *B31F 1/0025* (2013.01); *B31F 1/0087* (2013.01); *B31F 1/10* (2013.01); *B31F 5/022* (2013.01); *B31F 2201/0715* (2013.01); *B31F 2201/0741* (2013.01)

(58) Field of Classification Search
CPC ..... B31F 1/0025; B31F 1/0087; B31F 1/07; B31F 1/10; B31F 5/005; B31F 5/022; B31F 2201/0715; B31F 2201/0741
USPC ..... 493/144, 151, 244, 427, 434, 442, 445; 412/22, 29
See application file for complete search history.

(56) References Cited

U.S. PATENT DOCUMENTS 5,797,596 A * 8/1998 Morigami ..... B42C 1/12 270/58.11
6,106,453 A * 8/2000 Sinn ..... B26F 1/44 493/473
7,303,519 B2 * 12/2007 Jenkins ..... B31D 5/00 493/128
8,465,012 B2 * 6/2013 Ishikawa ..... B65H 45/30 270/45
8,490,957 B2 * 7/2013 Nagasako ..... G03G 15/6544 270/32
9,817,357 B2 * 11/2017 Kato ..... B65H 43/00
2006/0229184 A1 * 10/2006 Powell ..... B31F 1/10 493/467
2007/0072758 A1 * 3/2007 Van Oosterhout ..... B31F 1/07 493/355
2009/0062096 A1 * 3/2009 Sasahara ..... B65H 45/30 493/396
2009/0152789 A1 * 6/2009 Kikkawa ..... B65H 45/18 270/45
2009/0181840 A1 * 7/2009 Awano ..... B65H 45/18 493/399
2010/0207314 A1 * 8/2010 Hattori ..... G03G 15/6538 270/58.09
2011/0076081 A1 * 3/2011 Hattori ..... B65H 45/18 400/582
2011/0130260 A1 * 6/2011 Kikkawa ..... B65H 37/06 493/405
2011/0301008 A1 * 12/2011 Shibasaki ..... G03G 15/6573 493/405
2012/0115702 A1 * 5/2012 Ishikawa ..... G03G 15/6582 493/405
2012/0157285 A1 * 6/2012 Aiba ..... B65H 45/18 493/405
2012/0308334 A1 * 12/2012 Nonoshita ..... B31F 1/08 412/11
2014/0015187 A1 * 1/2014 Gamo ..... B65H 37/04 270/1.01

FOREIGN PATENT DOCUMENTS

DE 102008049617 A1 * 4/2010 ..... B65H 45/30
DE 10 2008 060073 A1 6/2010
EP 2 845 829 A1 3/2015

* cited by examiner

CREASING DEVICE FOR FORMING CREASES IN PAPER AND BOOKBINDING ARTICLES, AND MACHINE COMPRISING SUCH DEVICE

FIELD OF THE INVENTION

The present invention generally finds application in bookbinding and particularly relates to a creasing device for forming creases in paper articles, such as book covers and stacks of sheets to be bound in general.

The invention further relates to a machine for forming creases, which incorporates such device.

BACKGROUND ART

In the field of printing and bookbinding of stacks of sheet elements, devices for forming creases in hard or semi-hard covers, for the latter to be bonded to the lateral surfaces and the back of a stack to be bound, have been long known.

Creasing devices generally comprise a horizontal support plate for supporting the article to be creased, allowing the latter to be fed along a work area comprising at least one creasing unit.

Each creasing unit comprises a pair of tools placed on opposite sides of the support plate, which are equipped with a male tool, or punch, or a female tool, or recess, respectively, facing the corresponding opposite tools.

The tools of each pair are adapted to move relative to each other to contact the top and bottom faces of the cover and interact with their respective mating tools to form the crease.

One drawback of these prior art arrangements is that, if the device comprises multiple creasing units, all the tools placed above the plate form a first one-piece assembly and all the tools placed below the plate form a second one-piece assembly. This arrangement only affords minor changes to the crease-forming pattern, such changes also requiring the article to be turned upside down on the support plate, and hence involving much longer overall processing times, and affecting accuracy.

In an attempt to at least partially obviate this drawback, creasing devices have been developed, which comprise at least one pair of creasing tools, a movable tool and a stationary tool, wherein the latter has a stationary member and a displaceable member, and wherein the latter may be moved between an inactive position distal from the cover and an active position in which it interacts therewith.

By controlling the position of the displaceable member by means of appropriate actuators, one or more creases may be selectively formed with changing positioning patterns, without having to turn the article to be creased upside down.

DE102008060073 discloses a creasing device as discussed above, comprising a tool located above the support plane and adapted to move in a respective vertical direction, and a tool located below the support plane and comprising a pair of operatively separate members.

One of the lower members is stationary and is placed proximate to the cover to cooperate with the corresponding upper tool to form the crease as the upper tool is vertically translated.

The other member of the lower tool can be moved, using appropriate drive and guide means, between an inactive position, preventing interaction with the corresponding upper tool to form a corresponding crease, and an active position, closer to the article to be creased, in which interaction with the upper tool is allowed.

While this arrangement is more versatile and reduces processing times, it still suffers from the drawback that the drive and guide means comprise vertical linear actuators that are prone to rapid wear and require constant maintenance.

Therefore, after a given number of driving cycles, the actuators are no longer able to ensure accurate positioning of the displaceable member, thereby affecting efficient formation of creases thereby.

A further drawback is that, if the actuators are moved or deformed as a result of their interaction with the tools, they no longer ensure a safe and repetitive guiding action thereon.

Another drawback is that the device has a very large size and a highly complex construction.

Yet another drawback is that the actuators must be accurately calibrated and gaged to ensure a constantly repeatable crease formation.

US2012/0157285 and US2012/0115702 disclose creasing devices comprising a movable tool, adapted to contact the sheet to form creasing lines and guide means for proper positioning of the tool.

The guide means comprise at least one slot formed on the sidewall of the tool and a pin which slides within the slot along a substantially curvilinear path.

One drawback of these arrangements is that these devices do not allow accurate positioning of the creasing tool relative to the cardboard sheet that is being fed.

Technical Problem

In view of the prior art, the technical problem addressed by the present invention consists in providing a creasing device that has a constant operation over time, and provides a more effectively repeatable positioning of the tools using a relatively simple structure.

Disclosure of the Invention

The object of the present invention is to solve the aforementioned technical problem and obviate the above drawbacks, by providing a machine for automatic creation of packages that is highly efficient and relatively cost-effective.

A particular object of the present invention is to provide a creasing device that can ensure accurate and stable positioning of the creasing tools for a great number of operating cycles.

Another object of the present invention is to provide a creasing device that is little affected by clearances and tolerances between components, to thereby afford more accurate creasing.

Yet another object of the present invention is to provide a creasing device that has a relatively simple structure and requires little maintenance.

These and other objects, as more clearly explained hereafter, are fulfilled by a creasing device as defined in claim 1, which comprises a pair of tools, a stationary tool and a movable tool, located on opposite sides of a support plate, and each having at least one punch and at least one recess to form the crease.

The stationary tool comprises a stationary member and a height-adjustable member, which is associated with appropriate guide means adapted to translate and guide it between first and a second end positions.

The guide means are of the type having a curvilinear path contained in a plane substantially perpendicular to the support surface and may preferably comprise a cam with a slot having a first substantially horizontal portion and a second inclined portion, and a pin slidingly inserted in the slot.

In a further aspect, the invention relates to a machine for forming creases, incorporating the aforementioned device, as defined in claim 12.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a creasing device, which is described as a non-limiting example with the help of the annexed drawings, in which.

DETAILED DESCRIPTION OF A PREFERRED EXEMPLARY EMBODIMENT

Figure 1:
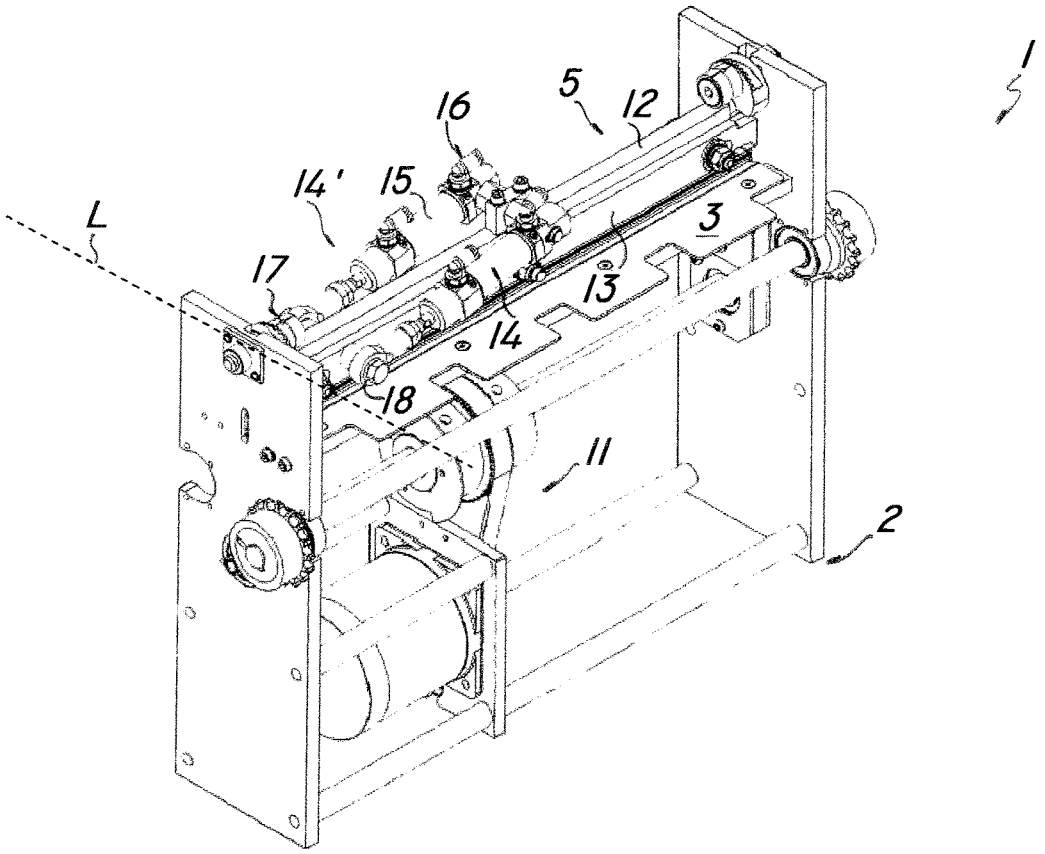
FIG. 1 is a perspective view of the creasing device of the invention.

Particularly referring to the figures, a creasing device for forming creases C in paper and bookbinding articles A, such as hard or semi-hard covers for binding stacks of sheets and sheet-like elements, is shown and generally designated by numeral 1.

Namely, the device 1 is designed to form creases $C_D$ defining the spine of the article A, hinge creases $C_C$ and flap creases $C_A$ using the same tools and without requiring the article A to be turned upside down during processing.

In a preferred embodiment of the invention the device 1 comprises a frame 2 with a substantially horizontal support surface 3 for supporting the article A and feeding it in a substantially longitudinal direction L.

Conveniently, the article A may be fed using conveyor belts or powered rollers 4, adapted to contact one of its top $F_S$ and bottom $F_I$ face is to drive it in the longitudinal direction L.

The device 1 comprises a pair of tools, a stationary tool 5 and a movable tool 6, which face each other and are placed on opposite sides of the support surface 3.

Figure 2:
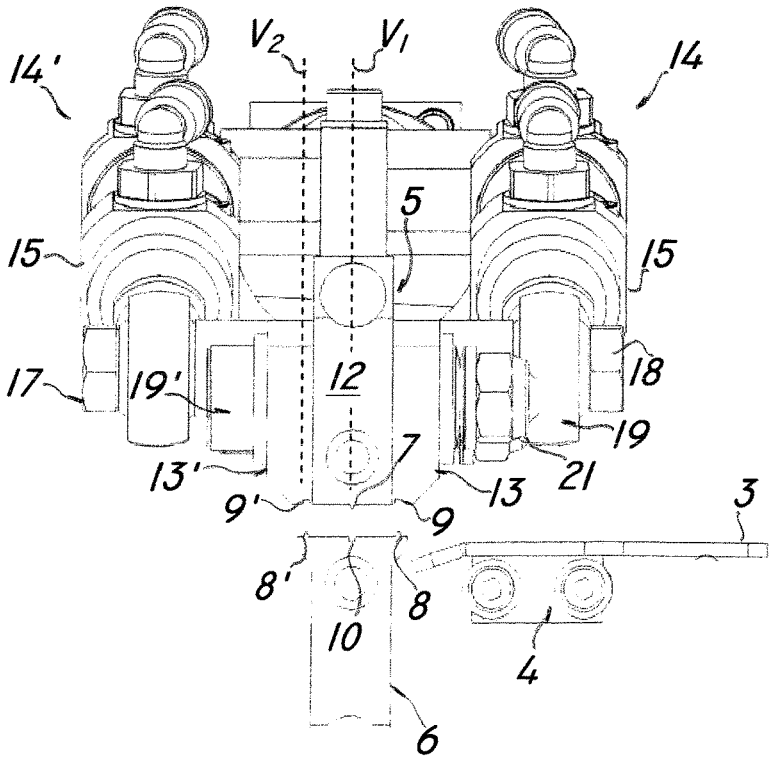
FIG. 2 is a front view of a first detail of the creasing device of FIG. 1.
Figure 3:
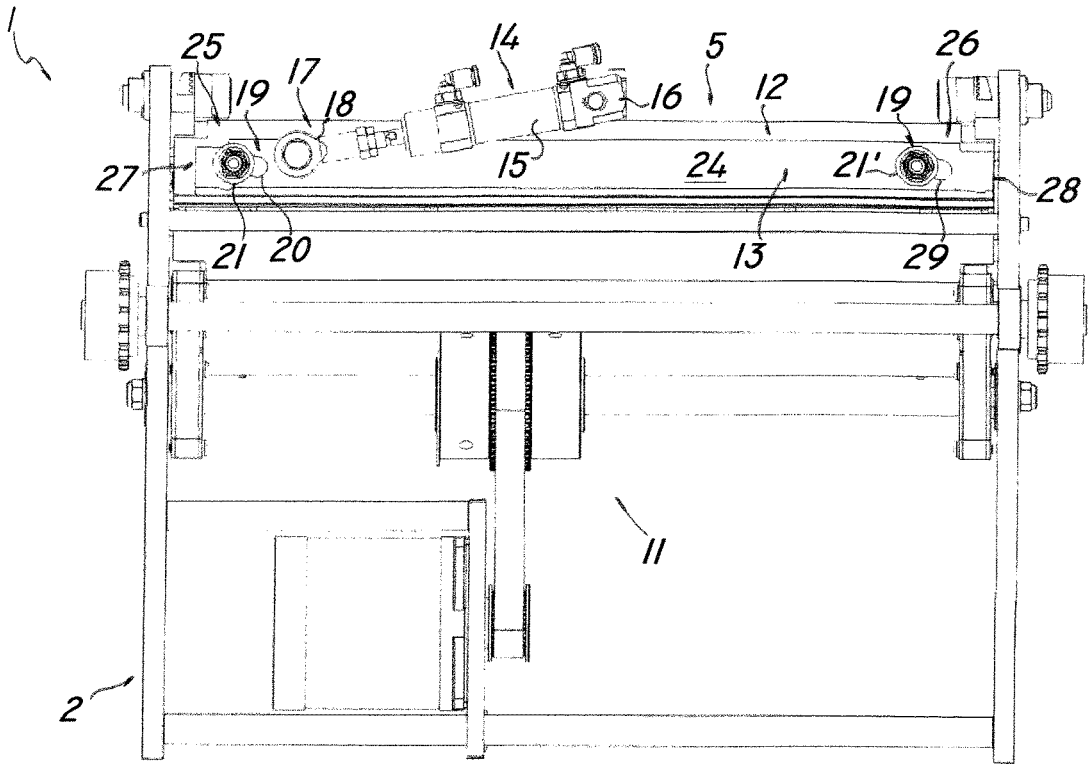
FIG. 3 is a lateral view of the creasing device of FIG. 1.

As shown in FIG. 2, each tool 5, 6 comprises at least one elongate punch 7, 8 and at least one elongate recess 9, 10, which are placed in longitudinally offset positions and whose shapes correspond to the opposite faces of the creases C.

Advantageously, the punch 7, 8 and the recess 9, 10 of each tool 5, 6 are designed to interact with the recess 10, 9 and the punch 8, 7 of the other tool 6, 5 in respective vertical directions $V_1$, $V_2$. Their interaction will cause the article A to be pressed there between to form respective creases C, having different orientations according to the positions of the punches 7, 8 and the recess 9, 10.

First actuator means 11 are provided, for acting on the movable tool 6 and translate it in the vertical direction toward the stationary tool 5, such that the latter may interact with the opposite faces $F_S$, $F_I$ of the article A to form the crease C.

In the configuration of the device 1 as shown in the figures, the stationary tool 5 is located above the support surface 3 and the movable tool 6 is located below it, whereby the first actuator means 11 translate the latter upwards toward the stationary tool 5.

Nevertheless, this configuration is only provided as an example and is not intended to limit the invention, as the position of the tools 5, 6 may also be reversed relative to the surface 3 and the movable tool 6 may be translated downwards, without departure from the scope of the invention.

The stationary tool 5 comprises a stationary member 12 that is rigidly joined to the frame 2, and at least one displaceable member 13 which is adjustable in height relative to the stationary member 12 and is operatively independent of the latter, as shown.

In a preferred, non-exclusive embodiment, the stationary member 12 and the displaceable member 13 consists of substantially vertical elongate rectangular plates of a given thickness, in mutual sliding contact relationship. Each plate may be formed with a respective recess 9 or a respective punch 7, facing a corresponding punch 8 or a corresponding recess 10 formed on the movable tool 6.

Conveniently, the punches 7, 8 and the recess 9, 10 have substantially mating shapes, excepting the thickness of the sheet material that forms the article A to be creased, interposed between the tools 5, 6.

Figure 6A:
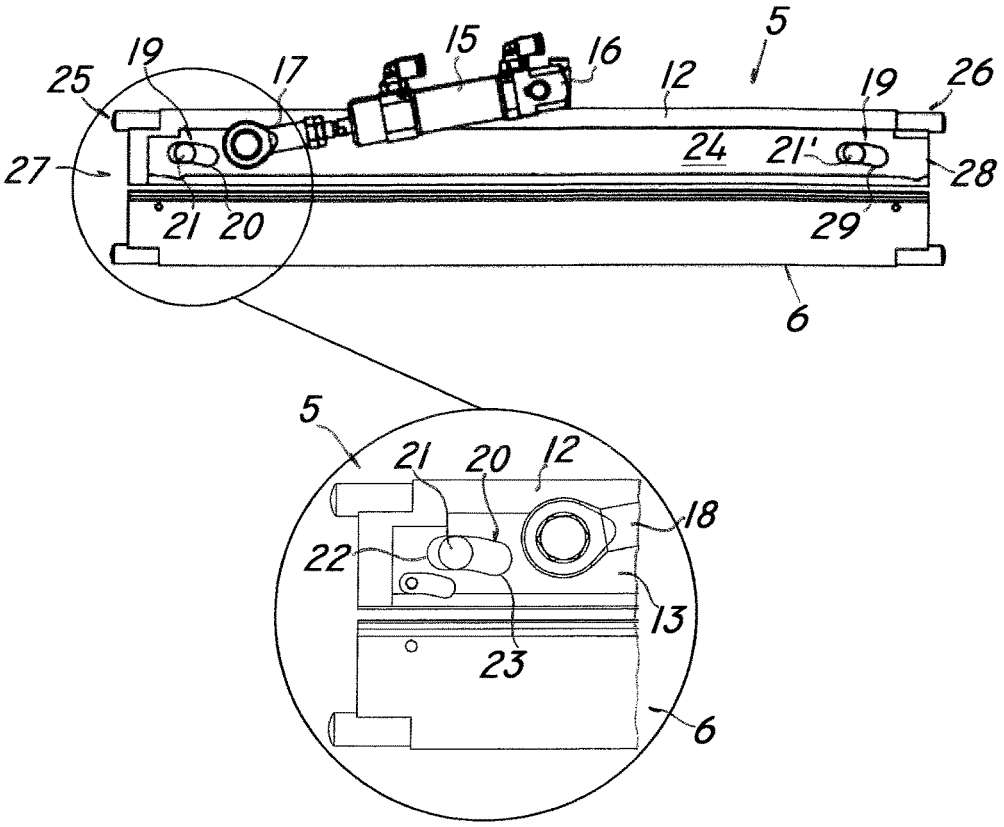
FIGS. 6A and 6B are lateral views with respective enlarged portions of a third detail of FIG. 3 in two different operating positions.
Figure 6B:
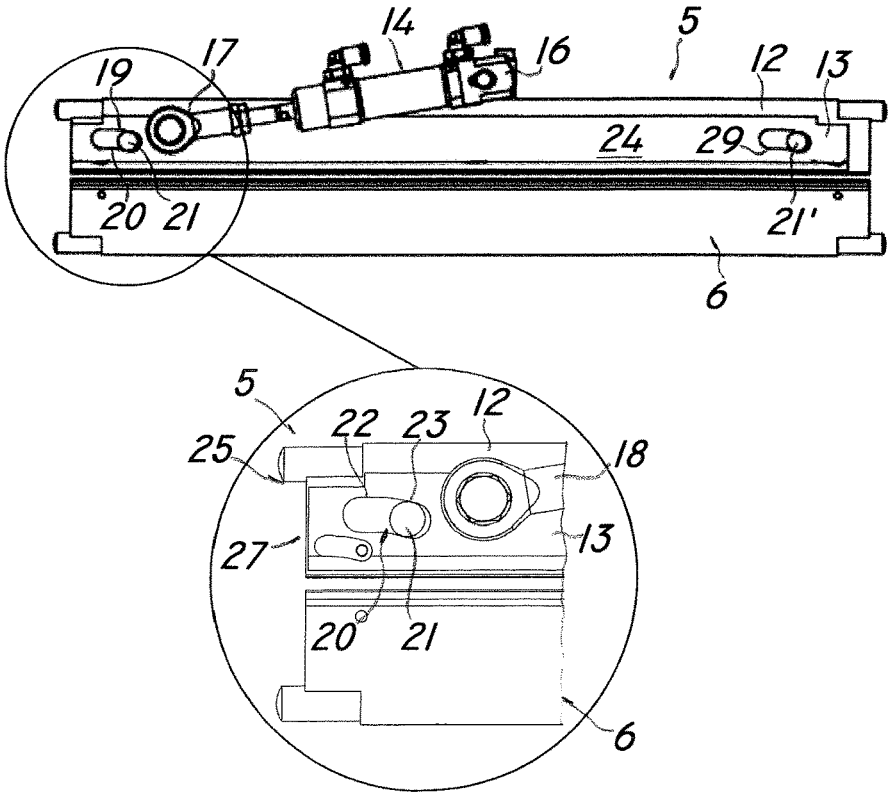

The displaceable member 13 is adapted to move between a first end position $P_1$, as shown in FIG. 6A, in which it is designed to interact with the movable tool 6 when the latter is vertically translated and a second end position $P_2$, as shown in FIG. 6B, in which it cannot interact with movable tool 6.

The displaceable member 13 is translated from the first end position $P_1$ to the second end position $P_2$ and vice versa by second actuator means 14 which act upon the displaceable member 13 to selectively change the configuration of the stationary tool 5 and form adjacent creases C with opposite orientations, without having to turn the article A upside down.

The second actuator means 14 may comprise a linear actuator 15, e.g. an electric or hydraulic actuator, having a first end 16 articulated to the frame 2 and a second end 17 hinged to each displaceable member 13 via a slider-crank mechanism 18 to translate it relative to the stationary member 12.

Conversely, the stationary member 12 is stably held in the first end position $P_1$ to interact with the movable tool 6 each time the latter is lifted to contact the respective face $F_I$ of the article A to form the crease C.

The device 1 further comprises appropriate control means, e.g. a programmable microprocessor or PLC, not shown, for selective actuation of the first 11 and second 14 actuator means to set the relative position of the displaceable member 13 relative to the stationary member 12 before translating the moving member 6.

The translational movement of the displaceable member 13, imparted by the second actuator means 14, occurs along guide means 19 associated with the stationary tool 5, as best shown in FIGS. 3 to 6B.

In the embodiment of the figures, the stationary tool 5 comprises a central stationary member 12 and a pair of lateral displaceable members 13, 13', as shown in FIG. 2, which comprise respective guide means 19, 19' and respective second actuator means 14, 14'.

Advantageously, the central stationary member 12 may have a median punch 7 and the displaceable members 13, 13' may have respective recesses 9, 9', located at the same distance from the median punch 7.

Furthermore, in this embodiment, the movable tool 6, consisting of a single elongate plate, has a median recess 10 and a pair of lateral punches 8, 8', facing the median punch 7 and the lateral recesses 9, 9' of the stationary tool 5, respectively.

Figure 4:
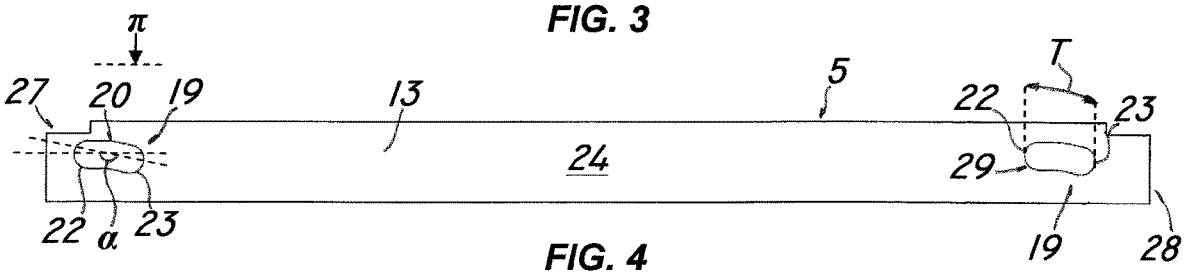
FIG. 4 is a lateral view of a second detail of the device of FIG. 1.

In a peculiar aspect of the invention, the guide means 19 are of the type having a curvilinear path T contained in a plane $\pi$ substantially perpendicular to the support surface 3, as shown in FIG. 4.

These guide means 19 are not connected to the control means and ensure repeatable, consistent positioning of the displaceable member 13, without requiring intensive maintenance.

Preferably, the guide means 19 comprise a cam consisting of at least one slot 20 formed on one of the members of the stationary tool 5, e.g. the displaceable member 13, and at least one pin 21 associated with the other member of the stationary tool 5, e.g. the stationary member 12, which is slidingly inserted in the slot 20 as a cam follower.

As best shown in FIGS. 4, 6A and 6B, the slot comprises a first horizontal portion 22 and a second portion 23 substantially sloped inclined downwards relative to the horizontal.

The first 22 and second 23 portions define respective sections of the curvilinear path T of the guide means 19 and form an angle $\alpha$ ranging from 160° to 170° at their junction.

The pin 21 may be slidingly guided within the slot 20 from the horizontal portion 22 when the displaceable member 13 is in the first end position P1, as shown in FIG. 6A, to the sloped down portion 23 when the displaceable member 13 is in the second end position P2, as shown in FIG. 6B and vice versa.

Furthermore, each slot 20 has a substantially constant width $\wedge$ which is slightly greater than the diameter Ø of the pin 21 to slidingly guide and smoothly move it from the first portion 22 to the second 23 portion and vice versa.

Thus, the configuration of the stationary tool 5 may be changed in a highly accurate and repeatable manner, with no drift or oscillation of displaceable member 13 occurring as it is being moved by the second actuator means 14, such member being stably held in its end positions $P_1$, $P_2$.

In the embodiment of the figures, each displaceable member 13, 13' may comprise at least one respective slot 20, 20' formed on the side wall 24, 24' opposite to the one that contacts the stationary member 12.

Preferably, as best shown in FIGS. 6A and 6B, the central stationary member 12 may have respective guide pins 21, 21' at its opposite transverse ends 25, 26, and each of the displaceable members 13, 13' may have respective slots 20, 20 at its opposite transverse ends 27, 28 for accommodating a respective pin 21, 21' therein.

Figure 5:
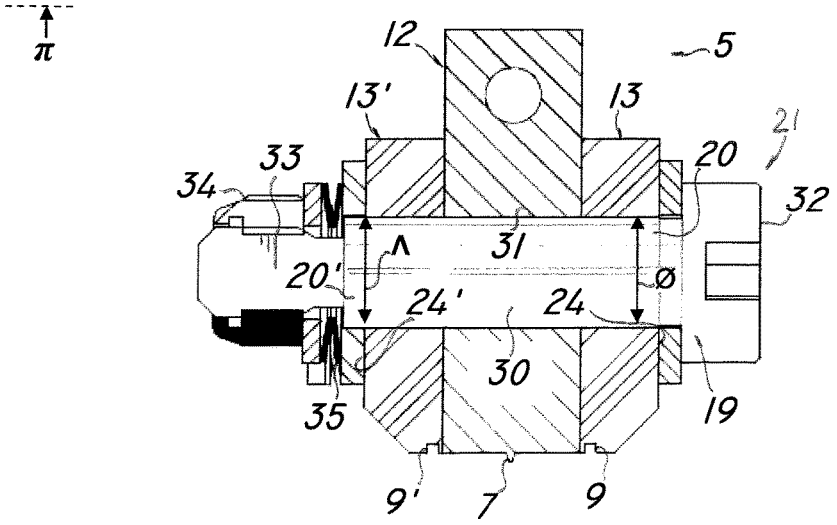
FIG. 5 is a broken-away front view of the first detail of FIG. 2.

As shown in FIG. 5, each pin 21, 21' fits in respective holes 30, 30' formed at the transverse ends 25, 26 of the stationary member 12 and has a smooth ground central portion 31 that is slidingly inserted in the slotted holes 20, 20'; 29, 29' and a head 32 at one longitudinal end for engagement of a wrench tool.

A threaded portion 33 is provided at the opposite longitudinal end of the pin 21 for tightening a locknut 34, at least one elastic element, e.g. a disk spring 35, being interposed between the locknut 34 and the displaceable member 13'.

In an alternative embodiment, not shown, the device 1 may comprise eccentric guide means 19 with a predetermined eccentricity, defining a substantially arc-shaped curvilinear path T.

In operation, as shown in FIGS. 7A to 7E, creases C are formed by first placing the cover A on the support surface 3 and feeding it toward the pair of tools 5, 6.

Then, when the cover A is level with the pair of tools 5, 6, the movable tool 6 is lifted to interact with the stationary tool 5, the latter having its two displaceable members 13, 13' in the second lifted end position $P_2$, with the pins 21, 21' placed in the inclined portions 23 of the slotted holes 20, 29.

Figure 7A:
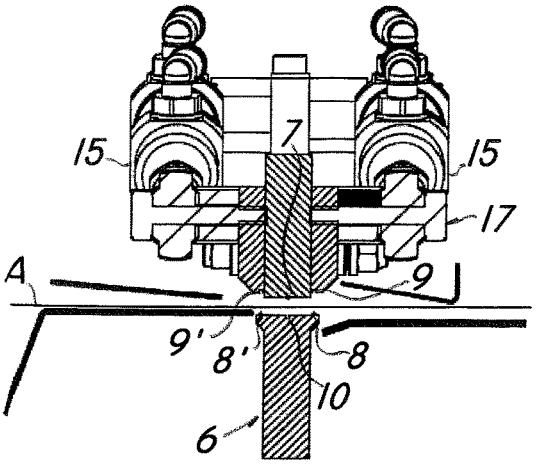
FIGS. 7A to 7E are lateral views of the first detail of FIG. 2 in different operating positions.
Figure 7B:
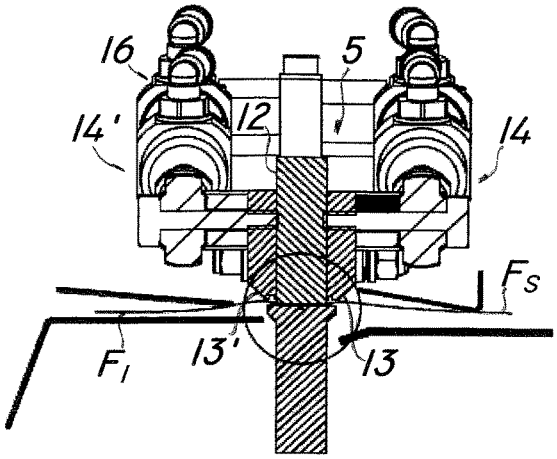

Thus, only the median punch 7 of the stationary member 12 will interact with the corresponding recess 10 of the movable tool 6, as shown in FIG. 7*b*, to form a single crease, corresponding to a flap crease $C_A$.

Then, the cover A is fed on the support surface 3 and the stationary tool 5 is configured with the displaceable members 13, 13' alternately placed in the first end position $P_1$ proximal to the cover A, with the pins 21, 21' alternately placed in the horizontal portion 22 of their respective slots 20, 29.

Figure 7C:
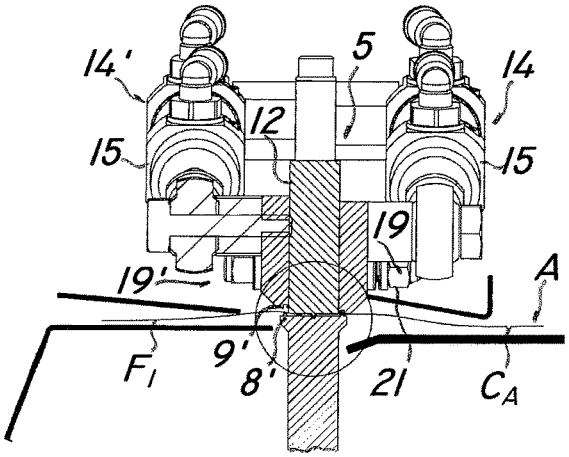
Figure 7D:
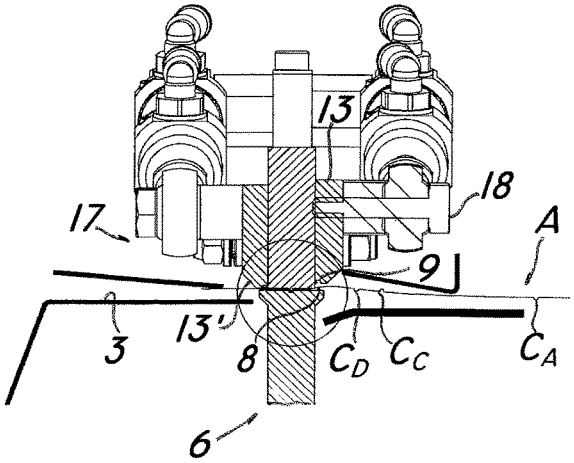

When the movable tool 6 is in the lifted position, the median recess 10 and one of the lateral punches 8, 8' alternately interact with the median punch 7 and the lateral recesses 9, 9' of the stationary tool 5, as shown in FIGS. 7C and 7D.

Each interaction of the movable tool 6 with the stationary tool 5, in this configuration, will cause the formation of a pair of creases C, i.e. a downwardly directed crease and an upwardly directed crease, which correspond to a spine crease $C_D$ and a hinge crease respectively $C_C$.

Therefore, selective translation of both displaceable members 13, 13' will afford the formation of a pair of creases, a spine crease $C_D$ and a hinge crease $C_C$.

Figure 7E:
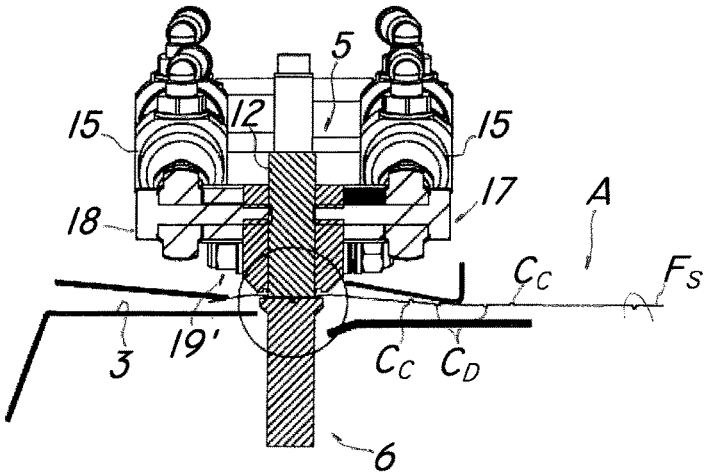

Finally, the article A is fed on the support surface 3 over a distance that is equal to the center-to-center distance of the creases C to be formed, and the stationary tool 5 is moved back to the configuration of FIG. 7B, with the displaceable members 13, 13' in the second end-position $P_2$, to cause the formation of a further flap crease $C_A$ when the movable tool 6, is lifted, as shown in FIG. 7E.

In a further aspect, the invention relates to a machine, not shown, for creasing sheet-like covers A, which comprises the above discussed creasing device 1.

The machine M further comprises a loading station for loading the articles A to be creased, a discharge station for discharging the creased articles A and means for transferring a cover at a time from the loading station to the support plate.

The machine M may be of stand-alone type, i.e. adapted to operate alone or be mounted to a known sheet-binding apparatus.

The creasing device and machine of this invention are susceptible to a number of changes or variants, within the inventive concept disclosed in the appended claims. All the details thereof may be replaced by other technically equivalent parts, and the materials may vary depending on different needs, without departure from the scope of the invention.

While the creasing device and machine have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in the publishing and bookbinding industries.

The invention claimed is:

1. A creasing device for forming creases in paper and bookbinding articles, said device comprising:

a frame with a substantially horizontal support surface for supporting an article to be creased and feeding it in a substantially longitudinal direction;

a stationary tool and a movable tool, reciprocally facing one another and placed on opposite sides of said support surface, wherein the stationary tool comprises a central stationary member integral with said frame and at least one lateral displaceable member whose position can be adjusted in height relative to said central stationary member, each of said movable tool and said stationary tool having at least one elongated punch and at least one elongated recess, which are located in longitudinally offset positions;

first actuator means acting upon said movable tool to move it toward said stationary tool and interact with the opposite faces of the article, to form a crease;

second actuator means acting upon said said at least one lateral displaceable member for selectively moving it between a first end position in which it is designed to interact with said movable tool and a second end position in which it cannot interact with said movable tool;

guide means associated with said stationary tool to guide said at least one lateral displaceable member between said first end position and said second end position;

said guide means defining a curvilinear path contained in a plane substantially perpendicular to said support surface and said longitudinal direction, said guide means comprising a cam consisting of at least one slot formed on one of said members and at least one pin associated with the other of said members for slidably insertion in said at least one slot, said at least one slot comprising a substantially horizontal first portion and a substantially sloped down second portion which is inclined relative to the horizontal, the portions defining respective sections of said curvilinear path, said central stationary member and said at least one lateral displaceable member being substantially vertical elongate rectangular plates in mutual sliding contact relationship, said at least one slot being formed on said at least one lateral displaceable member and said at least one pin being associated with said central stationary member, said central stationary member having a median punch, said at least one lateral displaceable member being one of two lateral displaceable members each having a side recess, said movable tool having a median recess and a pair of lateral punches facing the median punch and the side recesses of said stationary tool respectively.

2. A device as claimed in claim 1, wherein said at least one pin is slidingly guided by said horizontal portion of said at least one slot when said at least one lateral displaceable member is in said first end position, and by said sloped portion when said at least one lateral displaceable member is in said second end position, said at least one pin being smoothly movable from said first portion to said second portion and from said second portion to said first portion.

3. A device as claimed in claim 1, wherein the side recesses of said two lateral displaceable members are disposed at the same distance from said median punch.

4. A device as claimed in claim 3, wherein said central stationary member has respective guide pins at its opposite transverse ends, which are slidingly inserted in corresponding slotted holes formed at opposite transverse ends of each of said two lateral displaceable members.

5. A device as claimed in claim 4, wherein said central stationary member has respective holes at its opposite transverse ends, for receiving said guide pins, said guide pins each having a smooth, ground central portion slidingly inserted in a respective one of said slotted holes.

6. A device as claimed in claim 4, wherein said guide pins each have a head at one longitudinal end, for receiving a wrench tool, and a threaded portion at an opposite end for screwing a locknut, at least one elastic disk spring element being interposed between said lock nut and a respective one of said two lateral displaceable members.

7. A device as claimed in claim 1, wherein said second actuator means comprise a linear actuator with one end articulated to said frame and one end hinged to each of said two lateral displaceable members, whereby said two lateral displaceable members slide relative to said central stationary member along said guide means.

8. A device as claimed in claim 1, wherein said guide means are eccentric with a predetermined eccentricity defining said substantially arc-shaped curvilinear path.

9. A creasing machine for forming creases in paper and bookbinding articles, comprising a loading station for loading the articles to be creased, a discharge station for discharging the creased articles, means for transferring the articles from the loading station to the discharge station, further comprising a creasing device as claimed in claim 1 between said loading station and said discharge station.

* * * * *